US008961065B2

(12) United States Patent
Snoeck et al.

(10) Patent No.: US 8,961,065 B2
(45) Date of Patent: Feb. 24, 2015

(54) METHOD OF MILLING ASPHALT

(71) Applicant: Trimble Navigation Limited, Sunnyvale, CA (US)

(72) Inventors: Jeroen Snoeck, Westminster, CO (US); Richard Paul Piekutowski, Huber Heights, OH (US)

(73) Assignee: Trimble Navigation Limited, Sunnyvale, CA (US)

( * ) Notice: Subject to any disclaimer, the term of this patent is extended or adjusted under 35 U.S.C. 154(b) by 0 days.

(21) Appl. No.: 14/319,748

(22) Filed: Jun. 30, 2014

(65) Prior Publication Data

US 2014/0314481 A1 Oct. 23, 2014

Related U.S. Application Data

(62) Division of application No. 13/116,498, filed on May 26, 2011, now Pat. No. 8,794,867.

(51) Int. Cl.

| | |
|---|---|
| ***E01C 23/07*** | (2006.01) |
| ***E01C 23/08*** | (2006.01) |
| ***G06F 7/70*** | (2006.01) |
| ***E21C 25/00*** | (2006.01) |
| ***E01C 23/085*** | (2006.01) |

(52) U.S. Cl.

CPC ..... *E01C 23/085* (2013.01)
USPC ..... 404/84.05; 404/72; 404/90; 701/50; 299/39.6

(58) Field of Classification Search

USPC ..... 404/90, 93, 94, 96, 84.05, 84.1; 701/50; 299/1.5, 39.6
See application file for complete search history.

(56) References Cited

U.S. PATENT DOCUMENTS

| | | | |
|---|---|---|---|
| 3,158,945 | A | 12/1964 | Curlett et al. |
| 3,598,027 | A | 8/1971 | Swisher |
| 4,103,973 | A | 8/1978 | Cutler |
| 4,393,606 | A | 7/1983 | Warnecke |
| 4,403,889 | A | 9/1983 | Gillotti |
| 4,914,593 | A | 4/1990 | Middleton et al. |
| 4,918,608 | A | 4/1990 | Middleton et al. |
| 4,924,374 | A | 5/1990 | Middleton et al. |
| 4,926,948 | A | 5/1990 | Davidson et al. |
| 4,948,292 | A | 8/1990 | Haven et al. |
| 5,107,932 | A | 4/1992 | Zachman et al. |
| 5,184,293 | A | 2/1993 | Middleton et al. |
| 5,227,864 | A | 7/1993 | Yowler |
| 5,235,511 | A | 8/1993 | Middleton et al. |
| 5,375,663 | A | 12/1994 | Teach |
| 5,602,741 | A | 2/1997 | Talbot et al. |
| 5,862,501 | A | 1/1999 | Talbot et al. |
| 5,941,658 | A | 8/1999 | Dahlinger et al. |

(Continued)

*Primary Examiner* — Abigail A Risic

(57) ABSTRACT

A method of milling asphalt is disclosed. The result of a survey of the unmilled asphalt pavement surface adjacent to the area to be milled is received. The result of the survey is stored in a computer memory. A map of the design surface specifying the design elevation of the milled surface over the area to be milled is stored in the computer memory. The relative elevation of the unmilled asphalt pavement surface adjacent to the area to be milled with respect to the machine body and rotatable milling drum of an asphalt milling machine is sensed. The elevation of the bottom surface of the rotatable milling drum is determined using a computer processor. The elevation of the milling machine body and the rotatable milling drum is automatically adjusted such that the milling drum mills the asphalt surface to the design elevation over the area to be milled.

12 Claims, 5 Drawing Sheets

(56) References Cited

U.S. PATENT DOCUMENTS

| | | | |
|---|---|---|---|
| 5,987,379 | A | 11/1999 | Smith |
| 6,079,333 | A | 6/2000 | Manning |
| 6,082,927 | A | 7/2000 | Dahlinger et al. |
| 6,112,145 | A | 8/2000 | Zachman |
| 6,253,160 | B1 | 6/2001 | Hanseder |
| 6,299,934 | B1 | 10/2001 | Manning |
| 6,330,503 | B1 | 12/2001 | Sharp et al. |
| 6,371,566 | B1 | 4/2002 | Haehn |
| 6,400,452 | B1 | 6/2002 | Maynard |
| 6,421,627 | B1 | 7/2002 | Ericsson |
| 6,433,866 | B1 | 8/2002 | Nichols |
| 6,530,720 | B1 | 3/2003 | Green |
| 6,672,797 | B1 | 1/2004 | Zachman et al. |
| 6,691,437 | B1 | 2/2004 | Yost et al. |
| 6,729,796 | B1 | 5/2004 | Green |
| 6,838,277 | B1 | 1/2005 | Elashvili |
| 6,954,999 | B1 | 10/2005 | Richardson et al. |
| 7,003,386 | B1 | 2/2006 | Ericsson et al. |
| 7,139,662 | B2 | 11/2006 | Ericsson et al. |
| 7,144,191 | B2 | 12/2006 | Kieranen et al. |
| 7,168,174 | B2 | 1/2007 | Piekutowski |
| 7,245,999 | B2 | 7/2007 | Dietsch et al. |
| 7,295,911 | B1 | 11/2007 | Dietsch et al. |
| 7,552,539 | B2 | 6/2009 | Piekutowski |
| 7,559,718 | B2 | 7/2009 | Zachman et al. |
| 7,681,192 | B2 | 3/2010 | Dietsch et al. |
| 8,078,297 | B2 | 12/2011 | Lasher et al. |
| 8,091,256 | B2 | 1/2012 | Piekutowski et al. |
| 8,246,270 | B2 | 8/2012 | Berning et al. |
| 8,308,395 | B2 | 11/2012 | Jurasz et al. |
| 8,424,972 | B2 | 4/2013 | Berning et al. |
| 8,705,022 | B2 | 4/2014 | Taylor et al. |
| 2002/0047301 | A1 | 4/2002 | Davis |
| 2007/0052950 | A1 | 3/2007 | Taylor et al. |
| 2008/0133062 | A1 | 6/2008 | Lasher et al. |
| 2008/0152428 | A1 | 6/2008 | Berning et al. |
| 2009/0178816 | A1 | 7/2009 | Piekutowski et al. |
| 2010/0129152 | A1 | 5/2010 | Taylor |

METHOD OF MILLING ASPHALT

CROSS-REFERENCE TO RELATED APPLICATIONS

This application is a divisional application of and claims the benefit of co-pending U.S. patent application Ser. No. 13/116,498, filed on May 26, 2011, entitled "Asphalt Milling Machine Control and Method," by Jeroen Snoeck and Richard Paul Piekutowski, and assigned to the assignee of the present application.

STATEMENT REGARDING FEDERALLY SPONSORED RESEARCH OR DEVELOPMENT

Not Applicable.

BACKGROUND

This relates to asphalt milling machines and methods, and controls for such machines. Asphalt milling machines are commonly used to prepare an existing asphalt road for repaving. Although it is possible simply to pave over an existing asphalt road with an additional layer of fresh asphalt paving material, this may not be desirable for several reasons. It will be appreciated, for example, that repeated paving of a road with additional asphalt may result in the road being raised to an undesirable elevation with respect to the surrounding terrain. This is of particular concern in those cases where the road is bounded by curbs and side walks, and where there are manhole openings in the road. With such a road, the addition of even a single layer of asphalt over the existing asphalt pavement may be unacceptable. Further, it is also not uncommon for the upper portions of an asphalt road surface to be in disrepair at the time that repaving is to begin. Additionally, the asphalt road surface may have also developed longitudinal waves over time. Clearly, simply adding a layer of asphalt over an irregular or deteriorating road surface may result in a paved surface that is not as smooth or as durable as desired. For these reasons, it is common to prepare an asphalt road for repaving by removing a portion of the existing asphalt from the road, producing a relatively smooth, sound surface for application of the new asphalt layer. This process has the additional advantage that it is possible to reuse the asphalt material that is removed from the road as a part of a subsequent repaving process.

Asphalt is removed from the top surface of the road that is to be repaved with an asphalt milling machine designed for the process. It will be appreciated that it is important to be able to control the depth of the milling process and the elevation of the resulting surface. A design surface, i.e., the desired surface that will be used as the base for the application of a new layer of asphalt, must be ground or shaved with some care, since the elevation of the surface will determine the elevation and orientation of the repaved road to a significant degree. Further, a roadbed that is ground to an elevation that is too low will require more than the desired amount of repaving material. On the other hand, a roadbed that is ground to an elevation that is too high will result either in a repaved surface that is too high or in a layer of repaved asphalt that is too thin. Additionally, since roads are typically milled by milling machines in a series of two or more parallel, abutting milling passes, it is important that the adjacent milled areas be ground to the same elevation.

Various controls have been used with milling machines, such as those that sense a string line positioned adjacent the milling path. Most milling machine controls have used a side plate that slides over an adjacent surface, with a sensor monitoring the vertical movement of the plate and the control using sensor output to control milling depth. Many milling machine controls use side plates on both sides of the machine for referencing the grinding to adjacent surfaces on each side. Other milling grade and slope control systems have used sonic tracers that measure the reference surface, string line, or curb elevation with pulses of sonic energy that are directed downward and then reflected back to the sensor. Still other systems have added a total station with a total station target on the milling machine, combined with a slope sensor, so that the movement of the machine can be monitored and controlled relative to the desired grade.

For relatively simple jobs, the common approach has been to bench the side plate to the cutting head and then lower the head until the desired depth is obtained. This can be done on both sides, or on just one side and use a cross-slope sensor to obtain the desired grade on the other side. If something other than a uniform depth of cut were needed to correct the road surface, a different approach was required. In such an instance, a surveyor would mark the road surface with indications of the desired depth at various points, and possibly the slope at those points, as well. This approach requires a machine operator to observe these markings, and to adjust the control point manually to produce a smooth transition between target depths. For more complex surfaces this is difficult to do, requiring constant adjustment by the operator. While three dimensional systems using total stations are capable of making the transitions automatically and providing a very precise result, there are other difficulties with their use. One such difficulty is that the line of sight of the total station can be blocked by traffic or other obstructions. In addition, a transition from one total station to another total station may be required if the working path of the asphalt grinding machine extends far enough.

SUMMARY

An asphalt milling machine control is provided for an asphalt milling machine of the type which mills an asphalt pavement surface over which the asphalt milling machine travels. The machine has a milling machine body, and a rotatable milling drum mounted on the lower portion of the milling machine body, the bottom surface of the milling drum contacting the asphalt pavement surface to mill the surface to a relative or design elevation. The machine further includes a plurality of machine body supports which may be adjusted to raise or lower the height of the milling machine body and the rotatable milling drum with respect to the asphalt pavement surface. This defines the elevation of the surface that results from milling with the drum. The control includes a floating plate, mounted to the side of the milling machine and the rotatable milling drum, for sliding over the unmilled asphalt pavement surface adjacent to the area to be milled. The floating plate is vertically movable with respect to the machine body and the rotatable milling drum. The control includes a GNSS receiver on the machine body for determining the two dimensional coordinates of the floating plate. The control includes a memory storing data defining a three dimensional map of the unmilled asphalt pavement surface, and storing data defining a design surface which is to be milled by the asphalt milling machine. The control includes a sensor for detecting the relative vertical position of the floating plate with respect to the machine body and the unmilled asphalt pavement surface, and providing a sensor output. Finally, the control includes a processor, responsive to the GNSS receiver and the sensor, and operating in conjunction with the memory, for determining the desired elevation of the design surface in the area where the milling machine drum is in operation, for determining the elevation of the bottom surface of the milling drum, and for generating a correction value specifying the amount by which the milling machine drum is to be raised or lowered to bring the bottom surface of the milling machine drum to the desired elevation of the design surface.

The sensor for detecting the relative vertical position of the floating plate may comprise a wire rope sensor. The sensor may provide an output related to the elevation difference between the lower surface of the milling drum and the unmilled asphalt pavement surface adjacent to the machine over which the plate slides. The elevation of the lower surface of the milling machine drum may be determined by reference to the three dimensional map of the unmilled asphalt pavement surface over which the floating plate slides for the area determined by the GNSS receiver.

A method of milling asphalt at a design height with an asphalt milling machine, the asphalt milling machine having a milling machine body, a rotatable milling drum mounted on the lower portion of the milling machine body, the bottom surface of the milling drum contacting the asphalt pavement surface, may comprise receiving the result of a survey of the unmilled asphalt pavement surface adjacent to the area to be milled, storing the result of such survey in a computer memory, storing in the computer memory a map of the design surface specifying the design elevation of the milled surface over the area to be milled, sensing the relative elevation of the unmilled asphalt pavement surface adjacent to the area to be milled with respect to the machine body and rotatable milling drum, determining the elevation of the bottom surface of the rotatable milling drum using a computer processor, and automatically adjusting the elevation of the milling machine body and the rotatable milling drum such that the milling drum mills the asphalt surface to the design elevation over the area to be milled.

Determining the elevation of the bottom surface of the rotatable milling drum may include determining the elevation of the unmilled pavement surface adjacent to the area to be milled by reference to the results of the survey stored in memory. Automatically adjusting the elevation of the milling machine body and the rotatable milling drum may include comparing the elevation of the milling drum bottom surface and the elevation of the design surface to yield a correction value. The milling machine body and the milling drum may be raised and lowered in dependence upon the correction value. Determining the elevation of the bottom surface of the rotatable milling drum may be accomplished by determining the elevation of the unmilled pavement surface adjacent to the area to be milled by reference to the results of the survey stored in memory, and determining the elevation of the bottom surface of the rotatable milling drum by combining the relative position of the bottom surface of the milling drum and the elevation of the unmilled pavement surface adjacent to the area to be milled. The unmilled elevation of the asphalt pavement surface adjacent to the area to be milled may be determined by sensing the relative position of the surface with respect to the machine using a side plate, and then referring to the survey stored in computer memory.

A control is provided for an asphalt milling machine which mills an asphalt pavement surface over which the asphalt milling machine travels, the asphalt milling machine having a milling machine body, a rotatable milling drum mounted on the lower portion of the milling machine body, the bottom surface of the milling drum contacting the asphalt pavement surface to mill the surface to a design elevation, the asphalt milling machine further including a plurality of machine body supports which may be adjusted to raise or lower the milling machine body and the rotatable milling drum, thereby defining the elevation of the surface that results from milling with the drum. The control includes a sensor for detecting the relative vertical position of the unmilled asphalt surface adjacent the area to be milled with respect to the machine body and the lower surface of the rotatable milling drum, and providing a sensor output. The control includes a GNSS receiver on the machine body for determining the coordinates of the unmilled asphalt surface adjacent the area to be milled. The control includes a memory storing data defining a three dimensional map of the unmilled asphalt pavement, and storing data defining a design surface which is to be milled by the asphalt milling machine. Finally, the control includes a processor, responsive to the GNSS receiver and the sensor, and operating in conjunction with the memory, for determining the desired elevation of the design surface in the area being milled by the milling drum, for determining the elevation of the bottom surface of the milling drum, and for generating a correction value specifying the amount by which the milling machine drum is to be raised or lowered to bring the bottom surface of the milling machine drum to the desired elevation of the design surface.

The sensor for detecting the relative vertical position of the floating plate may include a floating plate which is vertically movable with respect to the milling machine body, and a wire rope sensor, sensing the relative position of the floating plate with respect to the milling machine body. The sensor may provide an output related to the elevation difference between the lower surface of the milling drum and the unmilled asphalt pavement surface adjacent to the machine. The elevation of the lower surface of the milling machine drum is determined by reference to the three dimensional map of the unmilled asphalt pavement surface over which the floating plate slides for the area determined by the GNSS receiver.

A method of milling asphalt at a design elevation with an asphalt milling machine is provided. The asphalt milling machine has a milling machine body, and a rotatable milling drum mounted on the lower portion of the milling machine body. The bottom surface of the milling drum contacts the asphalt pavement surface. The method includes surveying the unmilled asphalt pavement surface adjacent to the area to be milled, storing the result of such survey in a computer memory, storing in a computer memory a map of the design surface specifying the design elevation of the milled surface over the area to be milled, sensing the relative elevation of the unmilled asphalt pavement surface adjacent to the area to be milled with respect to the milling machine body and rotatable milling drum, determining the elevation of the bottom surface of the rotatable milling drum by determining the X and Y coordinates of the unmilled pavement surface adjacent to the area to be milled, referring to the survey of the asphalt pavement surface stored in computer memory to determine the elevation of the unmilled pavement surface adjacent the area to be milled, and combining the elevation of the unmilled pavement surface stored in computer memory with the sensed relative elevation of the unmilled pavement surface, and automatically adjusting the elevation of the milling machine body and the milling drum such that the milling drum mills the asphalt surface to the design elevation over the area to be milled.

Automatically adjusting may comprise comparing the elevation of the milling drum bottom surface and the elevation of the design surface to yield a correction value. The milling machine body and the milling drum may be raised and lowered in dependence upon the correction value. Determining the elevation of the bottom surface of the rotatable milling drum is accomplished by determining the elevation of the unmilled pavement surface adjacent to the area to be milled by reference to the results of the survey stored in memory, and determining the elevation of the bottom surface of the rotatable milling drum by combining the relative position of the bottom surface of the milling drum and the elevation of the unmilled pavement surface adjacent to the area to be milled. The unmilled elevation of the asphalt pavement surface adjacent to the area to be milled may be determined by sensing the relative position of the surface with respect to the machine using a side plate, and then referring to the survey stored in computer memory. The unmilled elevation of the asphalt pavement surface adjacent to the area to be milled may be determined by sensing the relative position of the surface with respect to the machine using a sonic transducer, and then referring to the survey stored in computer memory.

DESCRIPTION OF EMBODIMENTS

Figure 1:
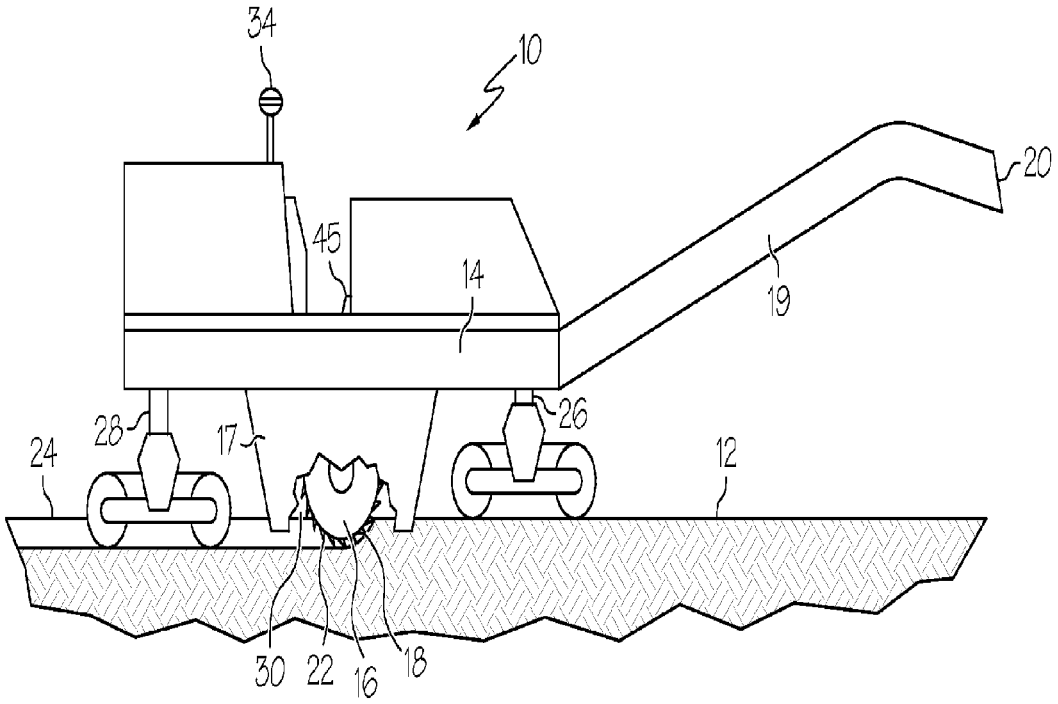
FIG. 1 is a side view of an asphalt milling machine.
Figure 2:
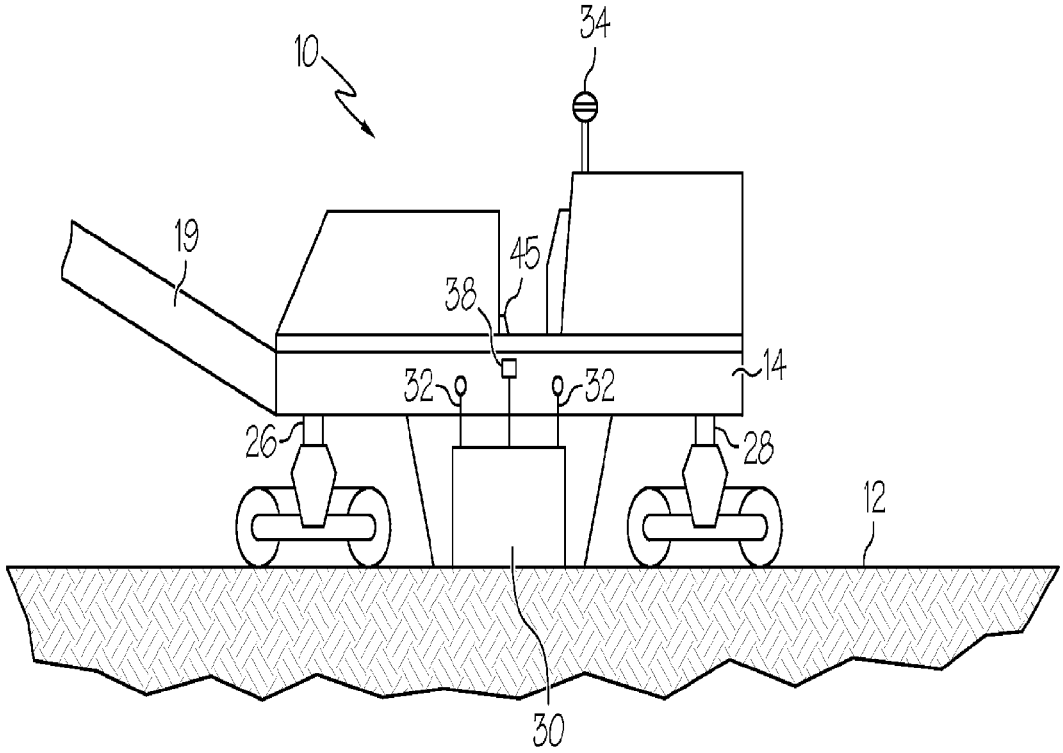
FIG. 2 is a side view of the asphalt milling machine of FIG. 1, as seen from the opposite side of the machine.
Figure 3:
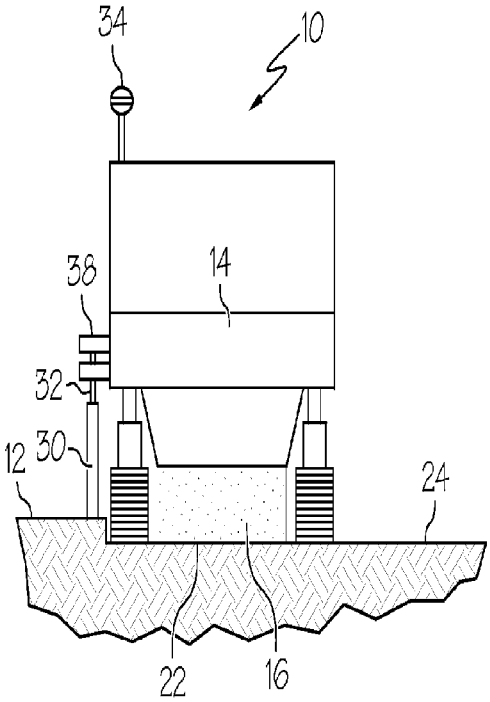
FIG. 3 is a rear view of the machine of FIGS. 1 and 2, as seen looking left to right in FIG. 1.

Reference is made to FIGS. 1-3, which illustrate an asphalt milling machine 10 of the type to which the control disclosed herein finds application. The asphalt milling machine 10 is used to mill an asphalt pavement surface 12 as the machine travels over the surface. The asphalt milling machine 10 has a milling machine body 14, and a rotatable milling drum 16, mounted on the lower portion of said milling machine body 14. The milling drum 16, which may be seen in FIG. 1 as a result of a portion of panel 17 being broken away, includes a plurality of milling teeth 18 positioned around its periphery for cutting into the surface of the asphalt during milling. Such teeth wear during the milling operation and are typically replaceable. An hydraulic motor (not shown) is typically used to rotate the milling drum 16.

The machine 10 moves forward over the asphalt surface during the milling operation, and the asphalt material that is milled from the road surface is collected by the machine and conveyed up a conveyor 19 at the front of the machine. The discharge end 20 of the conveyor 19 is positioned above a truck (not shown) that moves with the milling machine 10. The truck collects the loose asphalt material which is discharged from the conveyor 19. The bottom surface 22 of the milling drum 16 contacts the asphalt pavement surface 24 as the drum rotates to mill the surface 24 to a design elevation. The asphalt milling machine 10 includes a plurality of machine body supports 26 and 28 which may be adjusted hydraulically to raise or lower the milling machine body 14 and the rotatable milling drum 16 with respect to the asphalt pavement surface 24. Raising or lowering the milling machine body 14 and milling drum 16 raises or lowers the elevation of the surface that is milled with the drum 16. The four machine body supports 26 and 28 are typically extended or retracted as a result of the actuation of hydraulic cylinders (not shown). Since the drum 16 is secured to the body 14, raising and lower the body 14 also raises and lowers the drum 16. The machine body supports 26 and 28 have track drive arrangements at their lower ends which are driven by associated hydraulic motors. In some smaller asphalt milling machines, the track drive arrangements may be replaced by wheel drives.

The control for the asphalt milling machine includes a floating plate 30 that is mounted to the side of the milling machine 10 and the rotatable milling drum 16. The floating plate 30 is secured to mechanical links 32 which permit the plate 30 to move vertically and allow the bottom of the plate to slide over the unmilled asphalt pavement surface 12 adjacent to the area to be milled. The floating plate 30 is vertically movable with respect to the machine body 14 and the rotatable milling drum 16.

Figure 5:
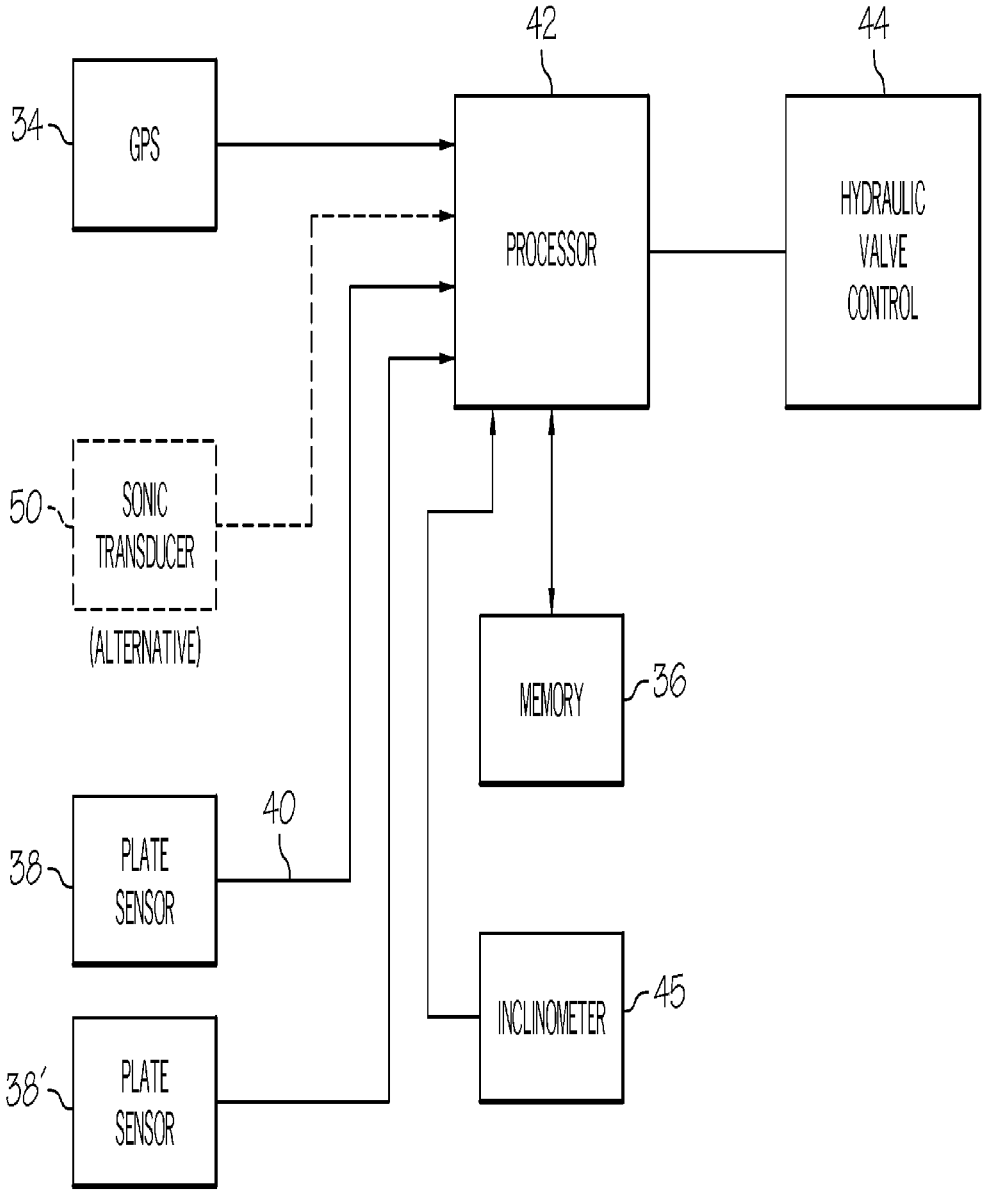
FIG. 5 is a schematic diagram of a control arrangement for the asphalt milling machine.

A GNSS receiver 34 is mounted on the machine body and is used to determine the position of the floating plate 30 and more specifically the two dimensional coordinates, i.e., the X and Y coordinates, of the floating plate 30. A memory 36 (FIG. 5) stores data defining a three dimensional map of the unmilled asphalt pavement surface 12. As will be explained further, below, by using the X and Y coordinates derived from the GNSS receiver, the three dimensional map stored in memory can be accessed to find an accurate Z coordinate. The three dimensional map is a database of points on the surface 12 which is derived through any of a number of surveying techniques. Although the points may be measured through manual surveying, it is contemplated that the surface 12 will be mapped using a laser scanning technique or other similar, more efficient techniques. The memory 36 also stores data defining the geometry of the design surface which is to be milled by the asphalt milling machine 10. The design surface will typically be specified by engineering personnel based on a number of factors.

A sensor 38 is provided for detecting the relative vertical position of the floating plate 30 with respect to the machine body 14 and the milling drum 16 and, more particularly, with respect to the lower surface 22 of the milling drum 16, and providing a sensor output on line 40. A processor 42 is responsive to the GNSS receiver 34 and the sensor 38. The processor 42, operating in conjunction with the memory 36, determines the desired elevation of the design surface in the area where the milling machine drum 16 is in operation, and determines the actual elevation of the bottom surface 22 of the milling drum 16. The processor 42 generates a correction value specifying the amount by which the milling machine drum 16 needs to be raised or lowered to bring the actual elevation of the bottom surface 22 of the milling machine drum 16 to the desired elevation of the design surface. This correction value is supplied to hydraulic valve control 44 which controls the actuation of the valves that extend or retract the four machine body supports 26 and 28, and thereby positions the drum 16 at the appropriate level to mill the design surface. The cross-slope inclination is measured with inclinometer 45 so that the supports 26 and 28 may also be adjusted to mill at a desired cross-slope orientation.

The sensor 38 which detects the relative vertical position of the floating plate 30 may comprise a wire rope sensor, sometimes referred to as a "yo-yo sensor." The sensor 38 includes a wire rope which is attached to the top of the plate 30. As the plate 30 moves vertically with respect to the body 14, the wire rope is extended from and retracted into the sensor body. The electrical output of the sensor, an indication of the extension of the wire rope, is indicative of the relative position of the plate 30 with respect to the body 14, the drum 16, and its lower surface 22 in grinding contact with the asphalt. As explained below, the sensor 38 provides an output related to the difference in elevation between the lower surface 22 of the milling drum 16 and the unmilled asphalt pavement surface 12 adjacent to the machine over which the plate slides. It is apparent, therefore, that if the elevation of the unmilled asphalt pavement surface 12 adjacent the machine in contact with the plate 30 is known, the elevation of the lower surface 22 and the resulting milled surface may also be determined. The lower surface 22 of the milling machine drum is therefore determined in part by reference to the three dimensional map, stored in memory 36, of the unmilled asphalt pavement surface 12, and in particular to the map data for the area in contact with the plate 30 as determined by the GNSS receiver 34.

Figure 4:
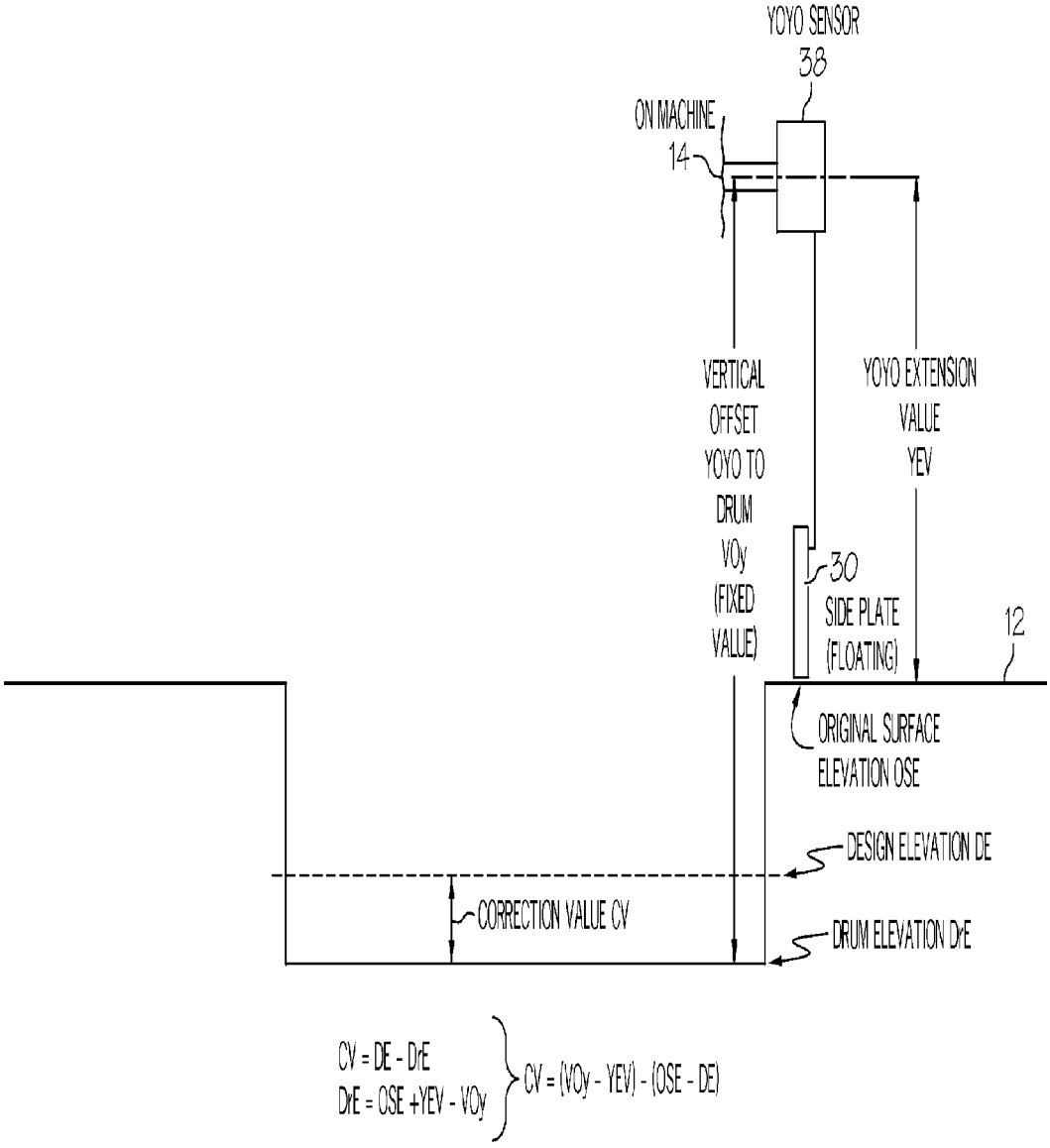
FIG. 4 is a diagrammatic cross-sectional view of an area being milled, as seen from the front of the machine, useful in explaining the machine and its operation.

As is apparent from FIG. 4, the elevation of the lower surface 22 of the drum 16, DRE is $$DRE=OSE+YEV-VOY,$$

where OSE is the elevation of the surface 12 at the point contacted by the plate 30, YEV is the distance from the surface 12 to the sensor 14, and VOY is the distance from the sensor 14 to the bottom surface 22 of the drum 16 where the grinding takes place.

A correction value, CV, is therefore $$CV=DE-DRE.$$

Combining these two, we have:

$$CV=(VOY-YEV)-(OSE-DE)$$

In other words, In other words, as this equation makes clear, the correction value CV is the difference between two difference values. The relative elevation of the bottom surface 22 of the milling drum 16 with respect to the unmilled surface 12 is determined by a first difference value between VOY and YEV. The relative elevation of the desired elevation of said design surface DE with respect to the unmilled asphalt pavement elevation OSE is determined by a second difference value between DE and OSE. The correction value CV, the amount by which the milling machine drum 16 is to be raised or lowered to bring the bottom surface 22 of said milling machine drum to the desired elevation of said design surface is then determined by the difference between the first difference value and the second difference value.

The correction value is continuously calculated by processor 42 and supplied to hydraulic valve control 44, permitting the elevation of the milling machine body 14 and the rotatable milling drum to be adjusted automatically such that the milling drum 16 mills the asphalt surface 24 to the desired design elevation.

It will be appreciated that by using the GNSS receiver to determine the X and Y coordinates of the plate 30, the accuracy of the system is enhanced. The surface 12 typically may have a slight inclination. Placing the plate on the surface 12 even with only moderate accuracy allows the elevation of the surface 12, which will vary only slightly within the surrounding area, to be used as a vertical reference with significant accuracy.

The method of control may include the steps of a.) surveying the unmilled asphalt pavement surface 12 adjacent to the area to be milled; b.) storing the result of such survey in a computer memory 36; c.) storing in the computer memory 36 a map of the design surface specifying the design elevation of the milled surface over the area to be milled; d.) sensing the relative elevation of the unmilled asphalt pavement surface 12 adjacent to the area to be milled with respect to the machine body 14 and rotatable milling drum 16; e.) determining the elevation of the bottom surface 22 of the rotatable milling drum 16 using a computer processor 42, and f.) automatically adjusting the elevation of the milling machine body 14 and the rotatable milling drum 16 such that the milling drum 16 mills the asphalt surface 24 to the design elevation over the area to be milled.

It will be appreciated that other methods may be used to determine the relative elevation of the surface 12 with respect to the milling machine 10. For example, a sonic transducer 50, shown in dashed lines in FIG. 5, may be used in lieu of the plate sensor 38. Such a sonic transducer is mounted on the side of the machine 10 and directs pulses of sonic energy downward. The sonic energy is reflected from the surface 12, and is sensed when it returns to the transducer 50. The processor 42 makes a time of flight calculation to determine the distance from the transducer 50 to the surface 12.

Figure 3A:
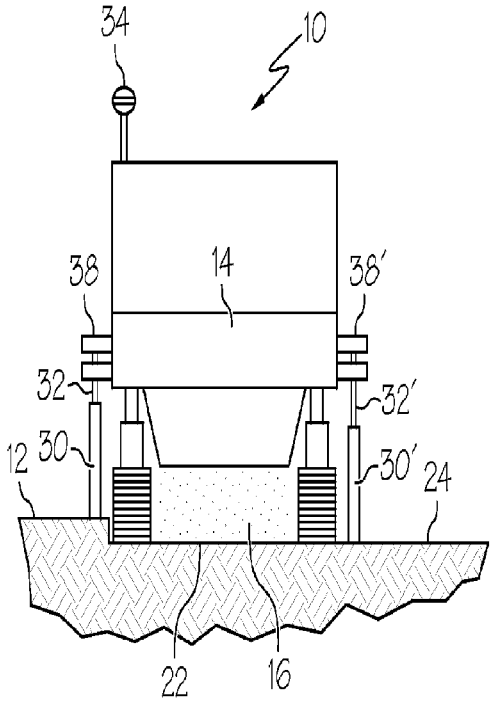
FIG. 3A is a rear view of the machine, similar to FIG. 3, but with a floating plate and sensor on both sides of the asphalt milling machine.

An additional sliding plate 30' and sensor 38', connected by a linkage 32', may be added to the second side of the asphalt milling machine 10, as shown in FIG. 3A. This arrangement has the advantage of using the previously milled surface 24 on the side of the machine as the reference surface on that side, thereby insuring a smooth transition between the areas milled in successive, adjacent milling operations. With this arrangement, the output of the inclinometer 45 may not be needed, since the elevations of both sides of the machine are set according to adjacent reference surfaces.

When a side plate slides over a surface which was previously milled, either with two side plates or when using a system with a single side plate, some way of detecting this is required to prevent driving the cutting drum 16 below the desired depth on the assumption that the plate is sliding over an unmilled surface. This can be accomplished in several ways. One way is to map the active milling activity and dynamically reset the stored target depth for a side sensor in that particular location while the machine mills. When a side plate runs over this area again, the control system knows that the area has already been milled to the design elevation, and then holds the cutting depth to zero on that side.

Various combinations of the multiple sensors may be used to cross check calculations, and determine errors in the operation of the system. As an example, the data from the GNSS receiver can be combined with the data from the left side plate sensor for elevation and the slope sensor to calculate what the right side sensor should read compared to the elevation defined by the pre-milled survey data and the finished design. If the system is operating properly, the right side plate sensor output will match either the pre-milled survey data or the finished design within allowed tolerances. Similarly, the two side plate sensors and the design should match the slope sensor. If a cross check does not match one of the two possible solutions within an allowable tolerance, this is an indication that a problem with a sensor is occurring. The system then can either operate from the data that the majority of the sensors provide, or sound an alarm for the operator, or both.

Errors in sensing elevation can occur in a number of ways. For instance, it is not uncommon for some of the asphalt to be ripped from the pavement unevenly during milling, rather than being smoothly cut for removal. This leaves holes in the newly milled surface. If one of the side plates were to pass over this area, the associated sensor would not give an accurate elevation reading. However, if the erroneous sensor element can be isolated in some fashion, the system can compensate, using the other side plate and slope sensor to control the side with the bad surface material. Another possible source of measurement error occurs when a side plate becomes lifted by a piece of material, and the material is then pulled along with the machine. Ultimately if the GNSS and slope solution does not match the elevation of either side plate at the surveyed or design depth within an acceptable tolerance, then the attention of the operator is required. This approach uses the side plates for elevation measurement, and automatically interprets the information provided to determine if a sensor is reporting outside its expected window. If this is the case, then compensation is provided for it, and the machine operator is notified of conditions outside the norm.

The milling machine control may include additional error checking capabilities. For example, the GNSS receiver 34 provides not only X and Y location information, but also Z (elevation) location information. While the Z location information may not be sufficiently accurate to use as a reference against which to set the elevation of the milling drum 16, nevertheless the elevation level measured with the GNSS receiver 34 may be compared against the Z coordinate derived above, using a three dimensional map of surface 12 that is stored in memory 36. If the two elevations agree within a set range, then the accuracy of the Z coordinate derived from the stored map is accepted. If, on the other hand, the two Z coordinates are outside of the set range, an error condition is indicated to the operator, or other corrective action is taken.

With a milling machine having two sensors 38 and 38' sensing the elevation on both sides of the milling machine, it is possible to use the previously milled surface to one side of the machine as a reference, as discussed above. In this case, the milling machine control uses the Z location information from the GNSS receiver, in conjunction with the sensors 38 and 38', and inclinometer 45, to derive anticipated elevation values for both the unmilled asphalt surface 12 adjacent to the area to be milled, and the previously milled surface 24 on the opposite side of the machine. If these anticipated elevations agree within a set range with the elevations that are measured, using the plates 30 and 30', sensors 38 and 38', inclinometer 45, and map data, then the accuracy of the Z coordinates derived from the stored map is accepted. If either is outside the set range, then the machine operator is notified that an error condition exists. The operator can then take appropriate steps to eliminate the error.

It will be appreciated that various changes to the control and method disclosed herein are contemplated.

What is claimed is:

1. A method of milling asphalt at a design height with an asphalt milling machine, said asphalt milling machine having a milling machine body, a rotatable milling drum mounted on the lower portion of said milling machine body, said bottom surface of said milling drum contacting said asphalt pavement surface, comprising receiving the result of a survey of the unmilled asphalt pavement surface adjacent to the area to be milled, storing the result of such survey in a computer memory, storing in the computer memory a map of the design surface specifying the design elevation of the milled surface over the area to be milled, sensing the relative elevation of the unmilled asphalt pavement surface adjacent to the area to be milled with respect to the machine body and rotatable milling drum, determining the elevation of the bottom surface of the rotatable milling drum using a computer processor, and automatically adjusting the elevation of the milling machine body and the rotatable milling drum such that the milling drum mills the asphalt surface to the design elevation over the area to be milled.

2. The method of milling asphalt at a design height with an asphalt milling machine according to claim 1, in which determining the elevation of the bottom surface of the rotatable milling drum includes determining the elevation of the unmilled pavement surface adjacent to the area to be milled by reference to the results of the survey stored in memory.

3. The method of milling asphalt at a design height with an asphalt milling machine according to claim 2, in which automatically adjusting the elevation of the milling machine body and the rotatable milling drum includes comparing the elevation of the milling drum bottom surface and the elevation of the design surface to yield a correction value.

4. The method of milling asphalt at a design height with an asphalt milling machine according to claim 3, in which the milling machine body and the milling drum are raised and lowered in dependence upon the correction value.

5. The method of milling asphalt at a design height with an asphalt milling machine according to claim 1, in which determining the elevation of the bottom surface of the rotatable milling drum is accomplished by determining the elevation of the unmilled pavement surface adjacent to the area to be milled by reference to the results of the survey stored in memory, and determining the elevation of the bottom surface of the rotatable milling drum by combining the relative position of the bottom surface of the milling drum and the elevation of the unmilled pavement surface adjacent to the area to be milled.

6. The method of milling asphalt at a design height with an asphalt milling machine according to claim 1, in which the unmilled elevation of said asphalt pavement surface adjacent to the area to be milled is determined by sensing the relative position of the surface with respect to the machine using a side plate, and then referring to the survey stored in computer memory.

7. A method of milling asphalt at a design elevation with an asphalt milling machine, said asphalt milling machine having a milling machine body, and a rotatable milling drum mounted on the lower portion of said milling machine body, said bottom surface of said milling drum contacting said asphalt pavement surface, comprising receiving the result of a survey of the unmilled asphalt pavement surface adjacent to the area to be milled, storing the result of such survey in a computer memory, storing in a computer memory a map of the design surface specifying the design elevation of the milled surface over the area to be milled, sensing the relative elevation of the unmilled asphalt pavement surface adjacent to the area to be milled with respect to said milling machine body and rotatable milling drum, determining the elevation of the bottom surface of the rotatable milling drum by determining the X and Y coordinates of the unmilled pavement surface adjacent to the area to be milled, referring to the survey of the asphalt pavement surface stored in computer memory to determine the elevation of the unmilled pavement surface adjacent the area to be milled, and combining the elevation of the unmilled pavement surface stored in computer memory with the sensed relative elevation of the unmilled pavement surface, and automatically adjusting the elevation of the milling machine body and the milling drum such that the milling drum mills the asphalt surface to the design elevation over the area to be milled.

8. The method of milling asphalt at a design height with an asphalt milling machine according to claim 7, in which automatically adjusting comprises comparing the elevation of the milling drum bottom surface and the elevation of the design surface to yield a correction value.

9. The method of milling asphalt at a design height with an asphalt milling machine according to claim 8, in which the milling machine body and the milling drum are raised and lowered in dependence upon the correction value.

10. The method of milling asphalt at a design height with an asphalt milling machine according to claim 7, in which determining the elevation of the bottom surface of the rotatable milling drum is accomplished by determining the elevation of the unmilled pavement surface adjacent to the area to be milled by reference to the results of the survey stored in memory, and determining the elevation of the bottom surface of the rotatable milling drum by combining the relative position of the bottom surface of the milling drum and the elevation of the unmilled pavement surface adjacent to the area to be milled.

11. The method of milling asphalt at a design height with an asphalt milling machine according to claim 7, in which the unmilled elevation of said asphalt pavement surface adjacent to the area to be milled is determined by sensing the relative position of the surface with respect to the machine using a side plate, and then referring to the survey stored in computer memory.

12. The method of milling asphalt at a design height with an asphalt milling machine according to claim 7, in which the unmilled elevation of said asphalt pavement surface adjacent to the area to be milled is determined by sensing the relative position of the surface with respect to the machine using a sonic transducer, and then referring to the survey stored in computer memory.

* * * * *